United States Patent [19]

Gibbs

[11] 4,389,016

[45] Jun. 21, 1983

[54] PARABOLOIDAL DRINKING FOUNTAIN ATTACHMENT

[76] Inventor: James T. Gibbs, P.O. Box 131-C, R.D. 3, Great Barrington, Mass. 01230

[21] Appl. No.: 258,960

[22] Filed: Apr. 30, 1981

[51] Int. Cl.[3] ..... E03B 9/20

[52] U.S. Cl. ..... 239/24; 239/505; 239/523

[58] Field of Search ..... 239/12, 16, 24, 25–27, 239/31, 499, 505, 507, 512, 523; 137/801; 4/638, 654; D15/118; 248/206 R, 363

[56] References Cited

U.S. PATENT DOCUMENTS

| | | | |
|---|---|---|---|
| 1,067,443 | 7/1913 | Schuchart | 239/27 |
| 1,704,408 | 3/1929 | Rosay | 239/25 |
| 1,781,599 | 11/1930 | Quisling | 239/25 |
| 1,814,953 | 7/1931 | Nelson et al. | 239/25 |
| 2,145,306 | 1/1939 | Hunneman | 239/24 |
| 2,366,427 | 1/1945 | Scheid | 239/25 |
| 2,533,636 | 12/1950 | Shoemaker | 239/24 |
| 2,915,944 | 12/1959 | Butts | 248/206 R X |

*Primary Examiner*—Andres Kashnikow

[57] ABSTRACT

This invention, titled Paraboloidal Drinking Fountain Attachment, provides a novel means for redirecting a stream of water from a faucet into an arc convenient for drinking. The invention is for use with a movable faucet and, when provided with an extension, also can be used with a stationary faucet. The small device, which can be molded inexpensively of a suitable plastic, incorporates a suction cup for easy attachment to any wall or to the floor of a sink within the arc of the faucet. The unique shape of the inner surface of the device, which may be a paraboloid, or a cone modified with a rounded bottom, or a truncated hemisphere, redirects the water stream of the faucet in a graceful and coherent arc. The shape enables users, by adjusting the position of the device relative to the faucet stream, to control the height and diameter of the drinking arc and also to aim it in any direction desired.

7 Claims, 7 Drawing Figures

FIG. 1
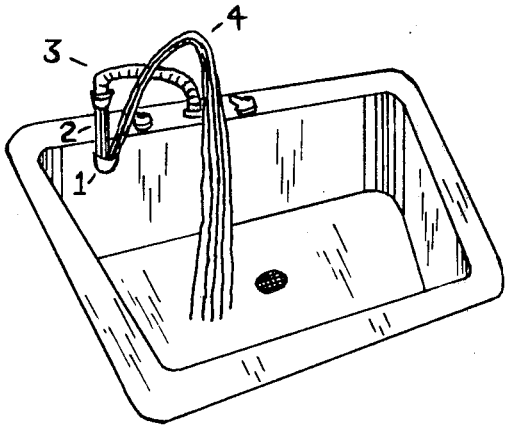
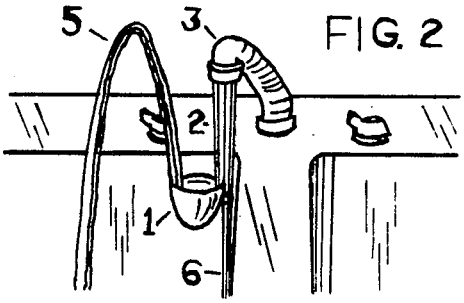
FIG. 2
FIG. 3
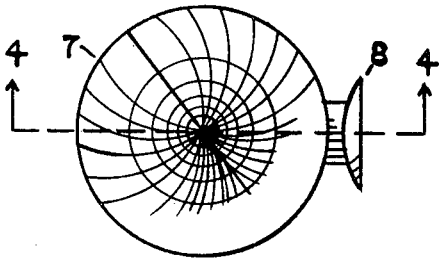
FIG. 4
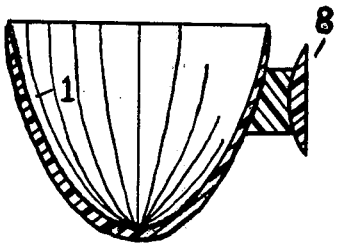

PARABOLOIDAL DRINKING FOUNTAIN ATTACHMENT

The primary object of this invention is to provide a novel means for redirecting a stream of water from a sink faucet into an arc convenient for drinking.

Earlier devices intended to redirect water from a faucet for drinking involved the inconvenience of attaching them to faucets or of holding them in a precise position. Such devices incorporated a curved tube or trough for redirecting the flow of water. My invention is of a unique shape and is designed for attachment, by means of an incorporated suction cup, to the wall or floor of any sink equipped with a faucet that is movable laterally, as are most modern kitchen sinks. When modified with a telescopic extension, the invention also can be used with sinks equipped with fixed faucets. It will be appreciated that the telescopic extension is a preferred embodiment and the various types of extension means can be used in its stead. Because my device is not attached to the faucet, it does not interfere with other uses of the faucet. Moreover, it can be removed easily from the sink, if desired.

If the suction cup is located on the side of the device, it may be attached to the rear wall of any sink equipped with a movable faucet or to either side of the divider wall of any double sink so equipped. If the suction cup is attached to the bottom of the device, which is a design choice, it may be attached to the floor of the sink. The device is positioned within the arc of the faucet outlet and below it, so that the water stream or part of it can be directed against the inner surface of the device at any point near its circumference.

The inner surface of the device incorporates the shape of a paraboloid, which is the best mode, or a cone modified to provide a rounded bottom, or a truncated hemisphere. The unique paraboloidal shape produces a stream of water redirected upward in a coherent arc that does not separate and that therefore facilitates drinking. The shape also enables the user to control both the height and the diameter of the stream, by positioning the device so that it redirects only part of the discharge from the faucet. The circular top of the device enables the user, by adjusting its position relative to the faucet outlet, to aim the arc of the fountain stream easily in any direction desired, which was difficult or impossible with the hand-held or fixed tubes and troughs of the prior art.

An object of this invention is to enable users to avoid the soiling of, and therefore the need for washing, drinking glasses as well as to avoid the use and expense of paper cups. Many such vessels are used for drinking water in the course of a day, particularly by a large family. A further object of the invention is to promote the health and economic well-being of users in several ways: It will facilitate and encourage the intake of the quantity of water essential for good health; it will retard the spread of infectious diseases that results from improperly washed or jointly-used drinking vessels; and it will restrict the consumption by both children and adults of expensive sugared soft drinks, thereby promoting healthier diets among users that will reduce dental decay and obesity.

In the accompanying drawing:

FIG. 1 is a perspective view showing the Paraboloidal Drinking Fountain Attachment positioned on the rear wall of a sink and operating to redirect the entire stream of water discharging from the movable faucet.

FIG. 2 is a closer perspective view of the device positioned on the left wall of the divider of a double sink and operating to redirect only part of the discharging water, which provides a lower and smaller drinking arc.

FIG. 3 is a plan view of the device.

FIG. 4 is a vertical sectional view of the device with a paraboloidal inner surface, the section being taken on Line 4—4 of FIG. 3.

Figure 7:
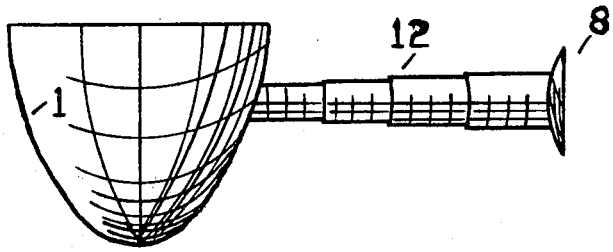
FIG. 7 is a vertical elevation showing the device modified with a telescopic extension.

Referring to the drawing, FIG. 1 illustrates the unique shape 1 of my Paraboloidal Drinking Fountain Attachment (which shape is shown more clearly in FIGS. 4 and 7). FIG. 1 shows the device positioned in such a manner that all of the discharge stream of water 2 from the movable faucet 3 is directed into the left rear inner surface of the device, which results in redirection of all of the stream in an arc 4 to the right and outward toward the front of the sink and the user.

FIG. 2 illustrates the device attached to the left side of the dividing wall of a double sink, which application permits redirection of the drinking arc close to the front of the sink, thus facilitating its use by small children. FIG. 2 shows the directing of only part of the discharge stream of water 2 into the device, with the result that the redirected drinking arc 5 is lower and of smaller diameter than that when all of the discharge stream is used. The remainder of the stream 6 is simply discharged into the sink.

FIG. 3 shows the circular shape 7 of the top of the device, which facilitates aiming the drinking arc in any direction desired. This is accomplished by positioning the device so that the faucet discharge stream or part of it enters the device near its circumference at a point opposite to the desired direction.

Figure 5:
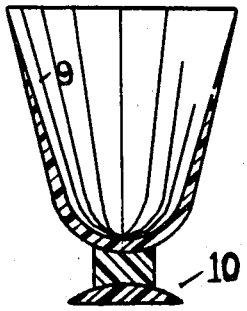
FIG. 5 is a vertical sectional view showing the inner surface as a cone modified with a rounded bottom and the suction cup located on the bottom of the device.
Figure 6:
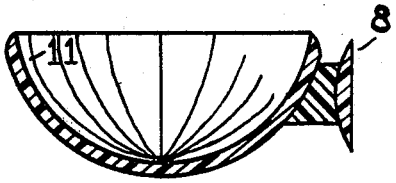
FIG. 6 is a vertical sectional view showing the inner surface as a truncated hemisphere.

FIG. 4 most clearly illustrates the paraboloidal shape 1 of the inner surface of the device and shows the lateral location 8 of the suction cup. FIG. 5 illustrates another shape of the inner surface of the device, namely, a cone 9 modified with a rounded bottom. This figure also shows the alternate design choice 10 of locating the suction cup on the bottom of the device, for attaching it to the floor of a sink. FIG. 6 illustrates another shape 11 of the inner surface of the device, which is a truncated hemisphere. The truncation of the hemisphere is such that the drinking arc is redirected outward as well as upward. FIGS. 4 and 6 depict the lateral location 8 of the suction cup, which permits attachment of the device to the wall of any sink made of smooth material such as stainless steel, porcelain, or stone.

FIG. 7 illustrates the device modified to incorporate a telescopic extension 12, which is shown in its fully extended position. This modification makes possible the use of the device with sinks equipped with fixed faucets such as those in most bathrooms. Users, including small children, can attach the device to the sink wall behind the fixed faucet and, by adjusting its position and the length of the extension, can redirect the discharge stream in any desired direction. The device can be stowed out of the way of the stream by closing the extension.

My Paraboloidal Drinking Fountain Attachment without an extension can be molded inexpensively and even as one piece of a suitable plastic material flexible enough so that the suction cup will operate but stiff enough so that the shape of the device will not be deformed by the force of the water stream discharging from the faucet.

I claim:

1. A drinking fountain attachment for use with water outlets comprising:

a cup having a substantially paraboloidally shaped inner surface for engaging water directed vertically downward and redirecting it into an upward mode in any direction throughout the 360 degrees of its perimeter, all of the sides of said cup slanting and converging inwardly and symmetrically toward the center point of the cup's bottom; and means for attaching the cup to a sink directly so that a water source can be directed into the cup any point on its perimeter.

2. The invention of claim 1 wherein the inner surface of the cup is cone-shaped in the upper part with a rounded bottom.

3. The invention of claim 1 wherein the inner surface of the cup is a truncated hemisphere .

4. The invention of claim 1, 2, or 3 in which the opened top of the cup is circular.

5. The invention of claim 4 in which the attaching means is a suction device attached to the cup and holds the cup to a sink by suction.

6. The invention of claim 5 wherein an extension means is placed between the suction device and the cup for positioning the cup under stationary liquid sources.

7. The invention of claim 6 wherein the extension means is a telescoping member.

* * * * *